United States Patent [19]

Hornüng

[11] Patent Number: 4,753,142

[45] Date of Patent: Jun. 28, 1988

[54] POWER-DRIVEN SCREWING HEAD

[75] Inventor: Ewald Hornüng, Rinteln, Fed. Rep. of Germany

[73] Assignee: Helfer & Co., KG, Weideweg, Fed. Rep. of Germany

[21] Appl. No.: 31,710

[22] Filed: Mar. 30, 1987

[30] Foreign Application Priority Data

Mar. 29, 1986 [DE] Fed. Rep. of Germany ..... 3610749

[51] Int. Cl.[4] ..... B25B 15/00

[52] U.S. Cl. ..... 81/429

[58] Field of Search ..... 81/429, 438, 439, 451, 81/29, 125

[56] References Cited

U.S. PATENT DOCUMENTS

| | | | |
|---|---|---|---|
| 1,124,981 | 1/1915 | Weaver | 81/125 |
| 3,403,711 | 10/1968 | Moore | 81/451 |
| 4,237,946 | 12/1980 | Leitner | 81/429 |
| 4,287,923 | 9/1981 | Hornung | 81/429 |

*Primary Examiner*—Frederick R. Schmidt
*Assistant Examiner*—Blynn Shideler
*Attorney, Agent, or Firm*—Penrose, Lucas, Albright, Pravel, Gambrell, Hewitt, Kimball & Krieger

[57] ABSTRACT

In order to be able to remove a screw that has been installed, in a power-driven screwing head, it is proposed according to the present invention that the recessed portion of smaller diameter be divided into two zones that extend in the longitudinal direction of the sleeve, there being a recessed portion of greater diameter between said zones.

2 Claims, 3 Drawing Sheets

POWER-DRIVEN SCREWING HEAD

The present invention relates to a power-driven screwing head as set out in the defining portion of patent claim 1.

A screwing head of this type is known from DE-PS No. 28 43 684 (U.S. Pat. No. 4,287,923). In this known device, once a screw has been inserted in a workpiece it is impossible to remove it if the direction of the drive motor is reversed. In practice, it is often necessary to remove a screw that has been inserted if, for example, it has been inserted in the wrong place or if parts that have been screwed together have to be separated once again.

It is here that the underlying concept of the invention comes into play. It is the task of the present invention to so improve this known device that it becomes a simple matter to remove a screw that has been inserted and to do so by the use of simple and reliable means.

Using a powered screwing head of the type under discussion, this task has been solved in that the recessed portion of smaller diameter is divided into two zones that extend in the longitudinal direction of the sleeve, a recessed section of greater diameter being located between these zones.

Because of the means according to the present invention, a screw that has been inserted can be removed once again. This is necessary, for example, in the event of poor insertion of a screw or if, for any reason, previously joined parts are to be separated from each other.

According to a further feature of the screwing head described by the present invention, with an electric motor as a source of motive power, said motor is to be switchable to run either clockwise or anticlockwise.

It is preferred that a collar be provided at the drive end of the sleeve, there being in this a longitudinal groove that extends from the one zone of the recessed portion of smaller diameter to end at the face end of the sleeve against which the coil spring abuts, there being a projection that can move along the groove attached to one part of the shank.

Figure 1:
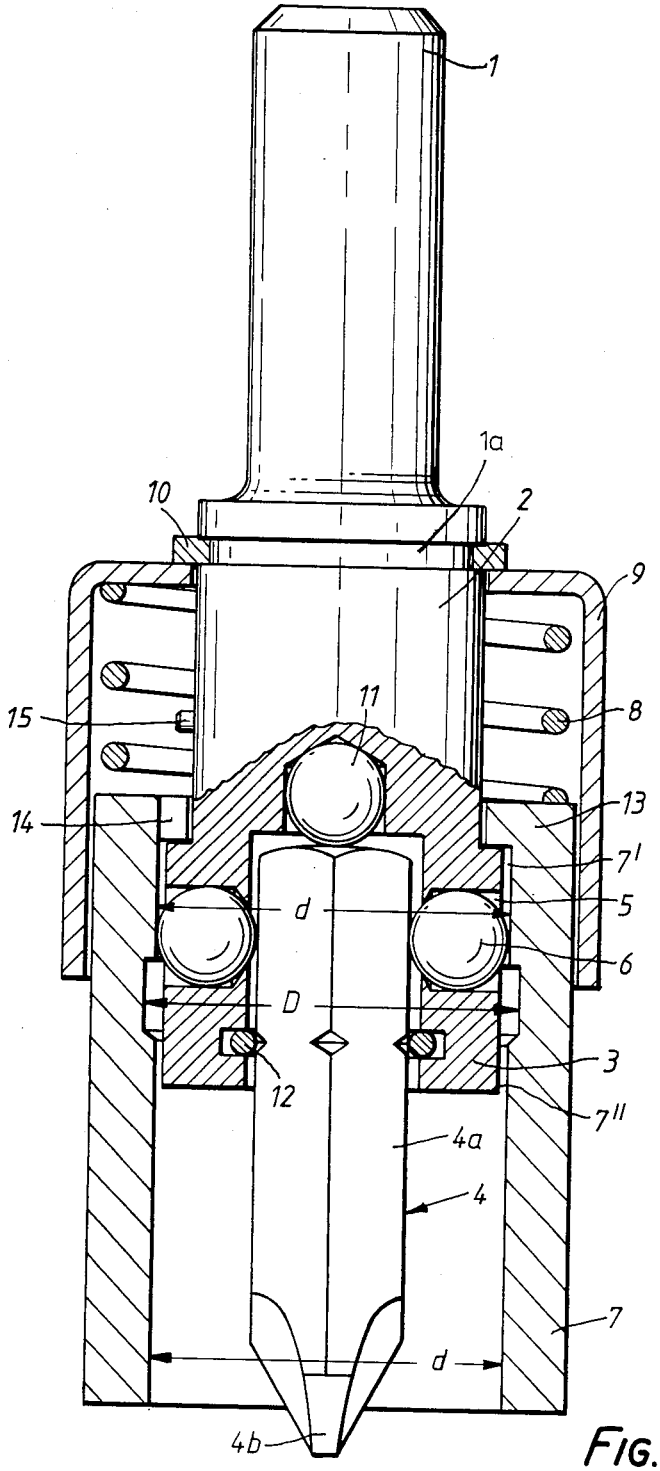
Figure 2:
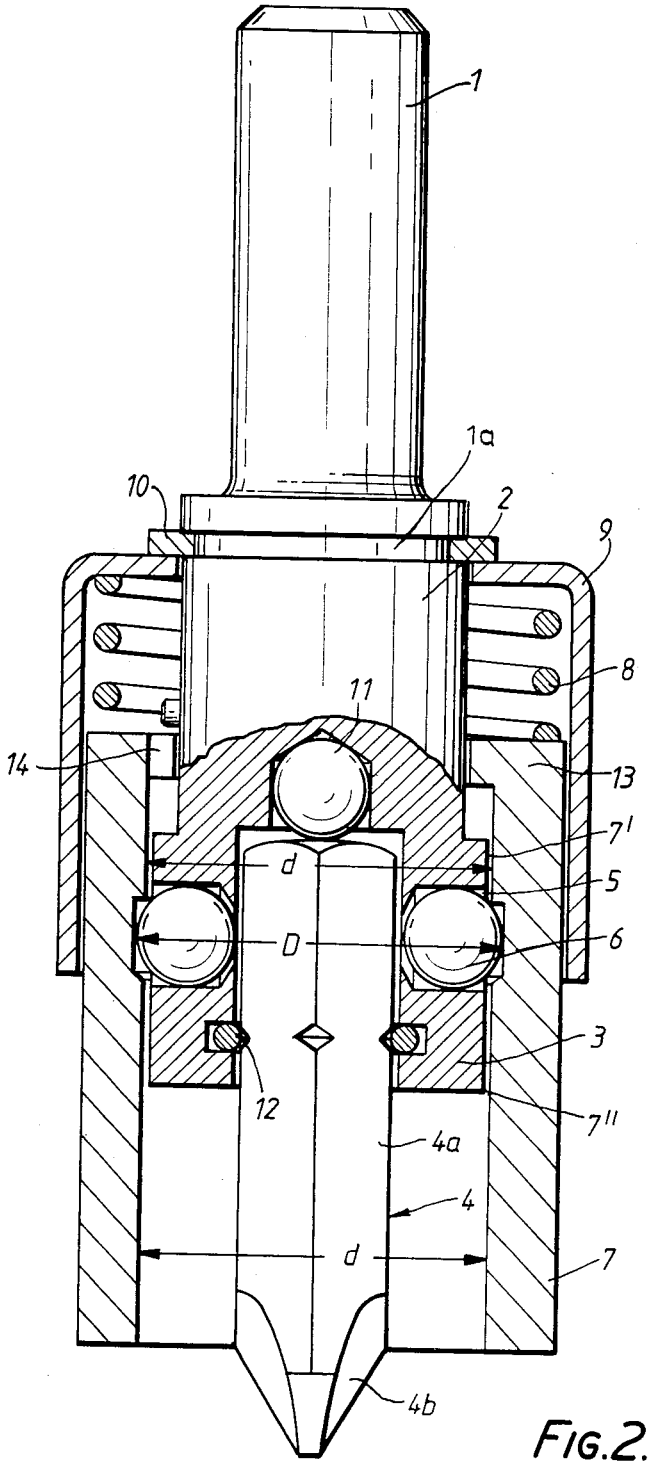
Figure 3:
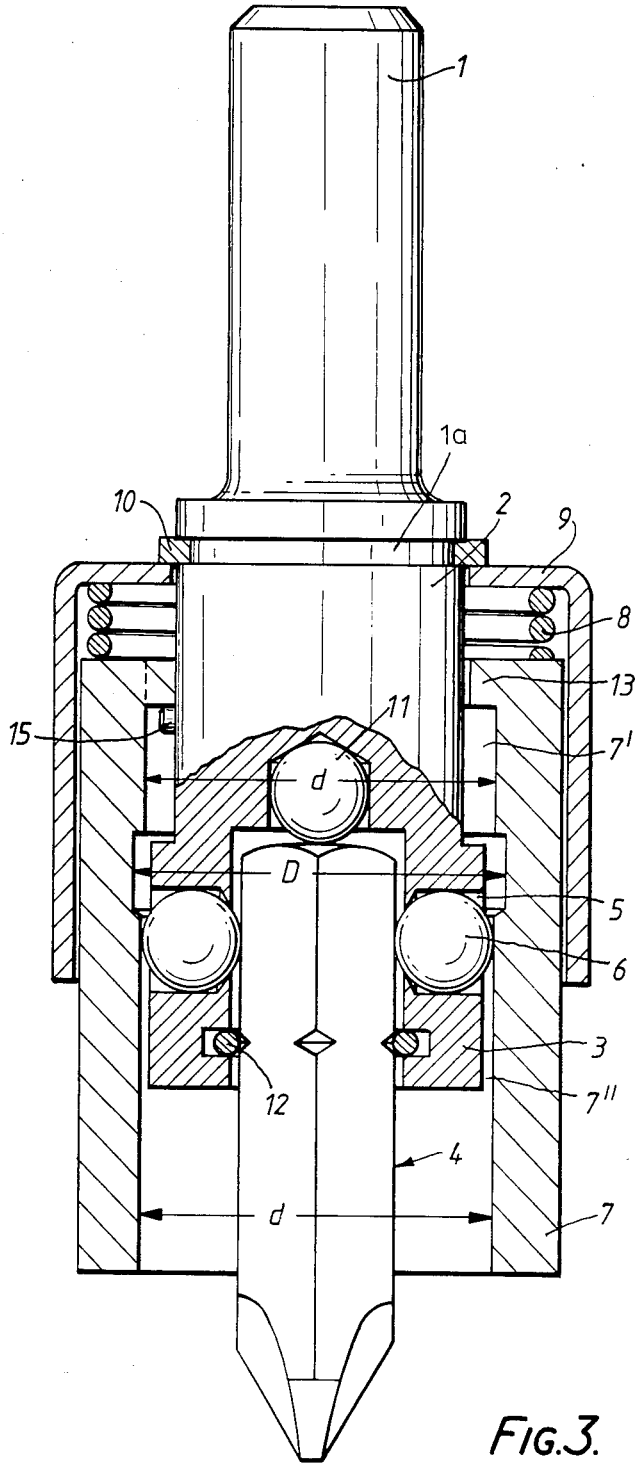

An exemplary version of the power-driven screwing head according to the present invention will now be described by way of example only with reference to the drawings, partly in section, of the screwing head, appended hereto. These purely schematic drawings are as follows:

FIG. 1: A partial cross-section view of the screwing head according to the present invention as during the insertion of a screw;

FIG. 2: A partial cross-section view of the screwing head according to the present invention, subsequent to the screwing procedure, in the released position;

FIG. 3: A partial cross-section view of the screwing head according to the present invention, during the removal process.

In the drawings, reference numbers 1 and 2 denote the shank and this is clamped in a suitable way in the chuck of a powered hand drill—not illustrated herein in the interests of greater clarity—so that the rotational movement of the drill shaft is transmitted to the chuck shaft 1,2. It is expedient that an electric motor be provided as a source of motive power, and that this be switchable so as to permit the selection of two directions of rotation so that its shaft can rotate either clockwise or anticlockwise.

At its end that is adjacent to the workpiece the shank 1,2 has a circular seat part 3.

The screwdriver bit 4 consists of a shank part **4*a* and the blade part 4*b*. The shank part 4*a* is in the form of a polygonal cylinder, which is to say a cylinder that is of polygonal cross-section. In the case of the embodiment that is illustrated in the drawings, the cross-section is a regular hexagon, although the invention is by no means confined to this embodiment. The internal diameter of the seat part 3 corresponds in this case to the width across the corners of the hexagonal shank part 4*a* of the screwdriver bit 4**.

The blade part **4*b* may be either a cruciform blade or chisel shaped, depending on whether it is to be suitable and used for screwing-in cross-slotted (Phillips-type) or straight-slotted screws. Of course, it can also be multi-edged for screwing in socketed head screws. In the case of the embodiment illustrated, the blade part 4*b*** is a cruciform blade.

Provided in the in the seat part 3 are radially extending bores in which locking balls 6 are movably disposed. The number of these coupling balls 6 may correspond to the number of plane faces on the shank part **4*a***, but it may also be smaller than the number of such plane faces.

The seat part 3 is enclosed by a casing in the form of a sleeve 7 that is axially biased by means of a spring 8. By means of the spring biased sleeve 7, the locking balls 6 can be moved into a locking or released position in which they are, respectively, engaged with the plane surfaces of the shank part **4*a* of the screwdriver bit 4** or are disengaged therefrom.

The length of the sleeve 7 is adapted to suit the depth to which the screw is to penetrate.

In its upper part, the sleeve 7 has a recessed section of inside diameter d, this section being divided into two zones 7' and 7'' that extend longitudinally. Between these two zones 7' and 7'' there is a recessed section or greater inside diameter D, into which the locking balls 6 can move when in the released position.

One end of the spring 8 is braced against one end face of the sleeve 7 while its other end is braced against a cup-shaped member 9 which surrounds the sleeve 7. This member 9 is secured in one direction against axial movement along the shank, in the embodiment illustrated, this being effected by a circlip 10 which is applied against the collar **1*a* on the shank 1 and against the bottom of the cup-shaped member 9. The ingress of direct into the head, and the consequent damage that this could cause, is precluded by virtue of the shape of the member 9**.

Located within the seat part 3 there is a thrust or step bearing against which the shank part **4*a* of the screwdriver bit 4 bears. In the drawings, this thrust or step bearing is formed by a ball 11**, which reduces to a tolerable level the friction forces occurring during the screwing and disengaging processes.

The screwdriver bit 4 is secured in the seat part 3 by means of an annular spring 12, so that it cannot fall out. In order that the locking balls 6 do not fall out when the screwdriver bit 4 is replaced, they are secured by means of stops, which are not shown in the drawings. These stops may expediently be formed in that the bores 5 taper at their ends that are proximate to the shank part **4*a* of the screwdriver bit 4**.

The length of the sleeve 7 can be varied so that different depths to which the heads of the screws may penetrate can be accommodated. These extension is not shown in the drawings. Such extension may expediently be achieved in that an extension piece is releasably connected to the sleeve 7 by a suitable method. A screwed connection is expedient, although other types of connection may be selected.

The sleeve 7, the locking balls 6 housed in the seat part 3, and the shank part 4a of the screwdriver bit 4 together form a separable coupling which, when a preselected depth of penetration of the screw is attained, automatically prevents the transmission of torque from the shank part 1 to the screw. Essential in this regard is that the shank part 4a be part of this coupling, so that when a worn-out screwdriver bit 4 is replaced, an essential part of the coupling is renewed at the same time, this tending to reduce wear on the coupling as a whole. Since the remaining parts of this coupling are subjected to scarcely any wear, replacing the screwdriver bit 4 provides a virtually new coupling.

As is clearly shown by the drawings, there is a collar 13 at the drive end of the sleeve 7, within which there is at least one longitudinal groove 14 that extends from the one zone 7' of the recessed section of smaller diameter d and ends in the face of the sleeve 7 against which the coil spring 8 is braced; a projection 15 is attached to the part 2 of the shank 1,2.

The mode of action of the power-driven screwing head according to the present invention is as follows:

Assuming it is desired to screw a screw having a cruciform slot into a plasterboard panel, then the blade part 4b of the screwdriver bit 4 is inserted into the cruciform slot in this screw. Next, the drill is operated and the front end face of the sleeve 7 is pressed against the plasterboard panel so that the screw penetrates the panel. Because of the pressure exerted on the drill, the sleeve 7 moves upwards against the force of the spring 8, in other words, into the cup-shaped member 9, the locking balls 6 being in the locking position, so that there is a force-locking connection between the seating part 3 and the shank part 4a of the screwdriver bit 4, through the locking balls 6.

Once the screw has reached the desired depth of penetration, the locking balls 6, in consequence of the extreme position of the sleeve 7 (topmost dead-centre position in the cup-shaped stop member 9) are able to move into the portion of the sleeve 7 with the extended diameter D so that the force-locking connection between the locking balls 6 and the shank part 4a of the screwdriver bit 4 is broken with the result that despite further rotation of the seating part 3, further penetration of the screw is rendered impossible (FIG. 2).

If the drill is moved back, so that there is no longer any contact between the front end face of the sleeve 7 and the panel, the spring 8 will move the sleeve 7 back into the locking position that is shown in the drawing, in which the force-locking connection between the locking balls 6 on the one hand, and the shank part 4a of the screwdrive bit 4 on the other is restored.

Should it be necessary, for whatever reasons, to remove a screw that has been inserted, all that is required is to move the sleeve 7 in an axial upwards direction from the position that is shown in FIG. 2, which is to say in the direction in which the screw is driven. The locking balls 6 are in the locking position, since they engage in the zone 7'' of the recessed section of smaller diameter d. As the sleeve 7 is being displaced upwards, the longitudinal groove 14 moves unhindered past the projection 15. As soon as this projection 15 is at the level of the lower annular surface of the collar 13, the sleeve 7 is so turned that the projection 15 can abut against this annular surface, as is shown in FIG. 3. The longitudinal groove 14 and the projection 15 function as a "bayonet fastening." In the position that is shown in FIG. 3 the screw that has been inserted can be removed providing that the direction of rotation of the drill motor is reversed, which is to say, is set so as to rotate anticlockwise.

I claim:

1. A power-driven screwing head including a device for automatically uncoupling the screwing head when a specified depth of penetration of a screw into a workpiece is attained, said head including a shank adapted to be driven in rotation in either sense having an end portion defined by a wall of annular cross-section defining a seat, a plurality of radial bores being defined through said wall, said shank further including a member projecting from said shank, a screwdriver bit having two ends, one of which is received in said seat, a sleeve surrounding at least said end portion of said shank, and movable longitudinally of said shank, said sleeve having an upper and a lower end, the lower end being adapted to be rested on a surface of the workpiece in use for driving in a screw, the sleeve defining an internal surface which includes along its axial length an upper zone, a recessed portion and a lower zone, the recessed portion being of larger diameter than the adjacent zones, a coil spring arranged between said member on said shank and said upper end of said sleeve, a plurality of locking balls each received in a respective one of said radial bores in said shank seat, said locking balls being movable radially in said bores so that said balls are held in engagement between the upper zone and the screwing head when the shank is being driven in one sense to drive a screw in, and the balls are held in engagement between the lower zone and the screwing head when the shank is being driven in the opposite sense in order to remove the screw, and the balls move radially out of engagement with said screwing head when said recessed portion of the sleeve is aligned with the bores.

2. A screwing head according to claim 1, wherein said upper end of said sleeve defines an inwardly projecting collar through which a longitudinal groove is defined extending from the upper zone to said upper end of the sleeve, said shank carrying a projection sized so that it can move through the longitudinal groove when aligned therewith.

* * * * *